United States Patent [19]

Morris

[11] Patent Number: 4,944,240

[45] Date of Patent: Jul. 31, 1990

[54] HULL FOR WATER CRAFT

[76] Inventor: James K. Morris, 312 N. Stadium Way #402, Tacoma, Wash. 98403

[21] Appl. No.: 224,493

[22] Filed: Jul. 26, 1988

Related U.S. Application Data

[63] Continuation of Ser. No. 816,151, Jan. 3, 1986, abandoned.

[51] Int. Cl.[5] ..... B63B 1/12

[52] U.S. Cl. ..... 114/283; 114/56; 114/61; 114/271

[58] Field of Search ..... 114/271, 272, 283, 288, 114/289, 290, 56, 61, 62, 67 A, 67 R

[56] References Cited

U.S. PATENT DOCUMENTS

| | | | |
|---|---|---|---|
| 2,193,892 | 3/1940 | Van Gorden | 114/290 |
| 2,271,277 | 1/1942 | Rosher | 114/271 |
| 2,729,183 | 1/1956 | Owen | 114/271 |
| 2,745,370 | 5/1956 | Manis | 114/61 |
| 3,236,202 | 2/1966 | Quady et al. | 114/61 |
| 3,424,120 | 1/1969 | Koriagin | 114/67 R |

*Primary Examiner*—Sherman D. Basinger
*Assistant Examiner*—Thomas J. Brahan

[57] ABSTRACT

A boat hull is designed with air passageway slots positioned at the stern of the craft. If the bow begins to rise thereby presenting the danger of the craft flipping, the air pressure, at a given point, is allowed to escape through the air passageways. Once the air begins to escape through the air passageways, the forces tending to flip the craft diminish and the bow of the boat lowers to the water.

3 Claims, 1 Drawing Sheet

HULL FOR WATER CRAFT

This is a continuation of application Ser. No. 816,151, filed Jan. 3, 1986, now abandoned.

BACKGROUND OF THE INVENTION

1. Field of the Invention

High speed water craft apparatus including a twin hull design which features passages for escape of air from beneath the boat when the hull begins to lift out of the water to the point where the craft is in danger of flipping.

2. Description of the Prior Art

The speed and stability of water craft are directly affected by the proportion of the craft which remains immersed in water while the craft is moving. The less contact with the water, the less hydrodynamic drag and the craft travels closer to maximum operating speed. Less immersion, however, also decreases stability and control. High speed water craft are able to travel at sufficient speeds to allow a craft to literally become airborne. On occasion, the bow of a high speed water craft is forced upward by air being forced below the craft. At times the volume and force of the air plunging beneath the bow is sufficient to cause the bow to lift upward and flip the craft over backward, resulting in serious injuries or death to the driver of the craft.

Various attempts have been made to design a hull for high speed water craft which will remain parallel to the water while still being able to travel at maximum speed. Air spoilers and other mechanisms have attempted through aerodynamics to prevent high speed flips.

In Patent 1,794,898 the hull design focused on float reconstruction so as to provide more rapid lifting of the hull from the water as acceleration occurs, thereby causing less hydrodynamic drag and offers minimum resistance and increased lateral stability.

In Patent 1,176,446 the hull design of the water craft is constructed so as to provide an even surface at the stern, thereby keeping the craft on an even keel at high speeds, thereby minimizing drag and vibration with increased overall stability.

In Patent 3,600,777, water craft hull design was constructed with air channels so as to provide increased lateral stability when making sharp turns at planing speed, as well as increased pitch stability.

In Patent 2,126,304, the water craft hull was designed to trap air beneath the hull between stabilizers for added planing ability as well as increased stability when turning sharply at high speeds.

In Patent 3,937,164 the hull design of a water craft was constructed so as to create a venturi chamber of air thereby increasing lift capabilities while at the same time providing positive stability to the craft. In addition, the power pad is designed to streamline air beneath the craft prior to contact with the propulsion source, resulting in higher efficiency of propulsion.

SUMMARY OF THE INVENTION

The primary force which causes the flipping of crafts is the on-rushing air. The air striking the hull pushes the craft towards a flip.

The present invention has two passageways or slots at the stern of the craft. These passageways allow for the escape of the air or wind striking the craft. By allowing for the escape, the air pressure diminishes, and the bow of the craft lowers to the water level.

DETAILED DESCRIPTION OF THE DRAWINGS

Figure 1:
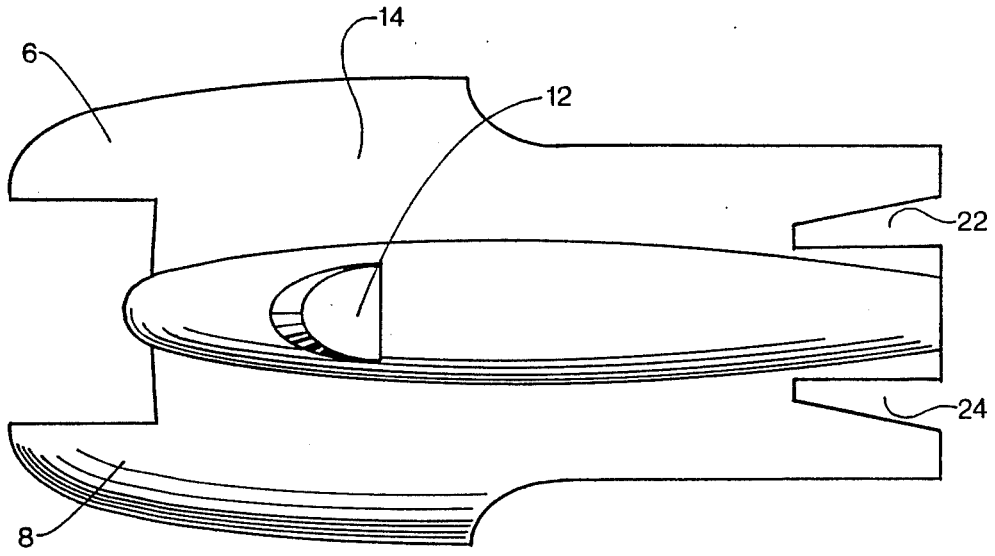
FIG. 1 is an overhead view of the hull illustrating the cutouts.

As set forth in FIG. 1, an overhead illustration of a hydroplane 10 is made up of the major elements of a hydroplane craft. The cab 12 is affixed to the hull 14. As extensions of the hull 14 are sponsons 16 and 18. The sponsons are the points at which the craft meets the water.

The sponsons 16 and 18 are the points at which the craft meets the water. Recessed from the sponsons is the bottom surface of the hull 20. The bottom surface of the hull goes entirely from the bow to the stern. However, as set forth in FIG. 1, at the rear of the stern are air passages can be designed in various configurations. The primary purpose of the air passages 22 and 24 are to allow for the passage of the air when the bow and sponsons rise from the water.

Figure 2:
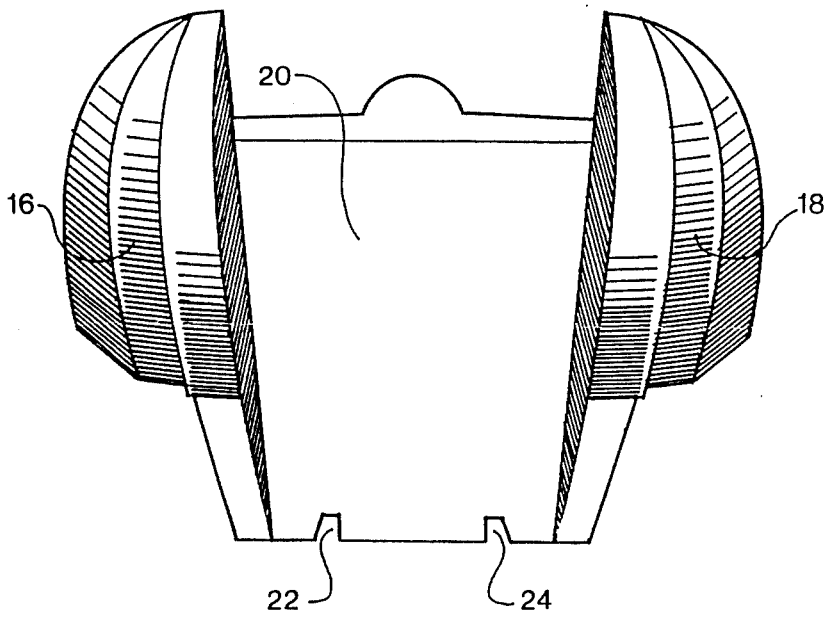
FIG. 2 is a bottom viewing of the hull with the bow rising.

FIG. 2 is an illustration of a hydroplane whose bow is rising and is potentially in a flipping condition. As set forth in FIG. 3, the bow has risen but the stern of the boat is still partially in the water. In a conventional craft, without air passages 22 and 24, there would be no possible escape for air pressure and the volume of air that is striking the craft would hit the craft at full force. However, in the present craft, with the air passages 22 and 24 allowing for the escape of onrushing air, the onrushing air can travel through the air passages and thus release pressure on the bottom surface of the hull 20. The escape of this air the lowering of the air pressure is sufficient to allow the weight of the bow to come back towards the water and prevent a flip of the boat.

The ability to release pressure through the air passageways 22 and 24 is of added importance when the craft runs into a sudden gust of wind or squall. In these events, as is set forth in the above paragraph, the hull rises to a point whereby the air passages begin lifting out of the water and are exposed to the onrushing air. Once the air begins rushing through the passages, the force tending to flip the craft is diminished and the hull sets back down towards the water.

Although a particular embodiment of the invention has been disclosed for illustrative purposes, it is to be understood that variations or modifications thereof which lie within the scope of the appended claims are contemplated.

I claim:

1. A hull for a hydroplane boat comprising: two longitudinal sponsons establishing the buoyancy of the hull at either side of an interconnecting hull portion wherein the interconnecting hull portion includes two cutouts which extend through the entire height of the hull and are positioned equidistant from the centerline of said hull, each of said cutouts having a straight side parallel to the longitudinal axis of the boat extending from the bow towards the stern, a second side extending generally perpendicular to said first side, with a third side extending back to the stern at an angle which steadily increases the width of the cutout as it extends aft and terminates at the stern thereby leaving an open aft.

2. The hydroplane of claim 1 wherein the length of the two cutouts are between 3 and 18 percent of the length of the hydroplane.

3. The hydroplane of claim 2 wherein the width of each cutout is between 10 and 30 percent of the width of the stern.

* * * * *